US006492080B1

(12) United States Patent
Burt et al.

(10) Patent No.: US 6,492,080 B1
(45) Date of Patent: Dec. 10, 2002

(54) PROCESS FOR TUNING PHOTORECEPTOR SENSITIVITY

(75) Inventors: Richard A. Burt, Oakville (CA); George Liebermann, Mississauga (CA); Cheng-Kuo Hsiao, Mississauga (CA); Ah-Mee Hor, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/815,116

(22) Filed: Mar. 23, 2001

(51) Int. Cl.[7] ..... G03G 5/047; G03G 5/06

(52) U.S. Cl. ..... 430/59.4; 430/78; 430/133; 430/134; 430/135

(58) Field of Search ..... 430/78, 59.4, 133, 430/134, 135

(56) References Cited

U.S. PATENT DOCUMENTS

| | | | | | |
|---|---|---|---|---|---|
| 5,418,107 | A | * | 5/1995 | Nealey et al. | 430/134 |
| 5,456,998 | A | | 10/1995 | Burt et al. | 430/58 |
| 5,466,796 | A | | 11/1995 | Burt et al. | 540/139 |
| 5,472,816 | A | | 12/1995 | Nukada | 430/78 |
| 5,493,016 | A | | 2/1996 | Burt et al. | 540/139 |
| 5,521,306 | A | | 5/1996 | Burt et al. | 540/141 |
| 5,588,991 | A | | 12/1996 | Hongo et al. | 117/2 |
| 5,759,726 | A | * | 6/1998 | Tambo et al. | 430/78 |
| 2002/0034699 | A1 | * | 3/2002 | Sasaki et al. | 430/78 |

FOREIGN PATENT DOCUMENTS

| | | | |
|---|---|---|---|
| JP | 2280169 | A | * 11/1990 |
| JP | 7247441 | A | * 9/1995 |
| JP | 7252429 | A | * 10/1995 |
| JP | 10017784 | A | * 1/1998 |
| JP | 10130525 | A | * 5/1998 |
| JP | 11035842 | A | * 2/1999 |
| JP | 11217512 | A | * 8/1999 |

* cited by examiner

*Primary Examiner*—Christopher Rodee
(74) *Attorney, Agent, or Firm*—Robert Thompson

(57) ABSTRACT

A process including: forming a first chlorogallium phthalocyanine (ClGaPc) in N-methyl-2-pyrrolidone (NMP) to form a ClGaPc (NMP) Type-I product; forming a second chlorogallium phthalocyanine in dimethyl sulfoxide (DMSO) to form a ClGaPc (DMSO) Type-I product; separately dry milling and then wet treating the Type-I products to form respective Type-II products; blending the Type-II products together along with a resin to form a coating mixture; and coating the mixture to form a charge generator layer in an electrostatographic imaging article.

17 Claims, No Drawings

PROCESS FOR TUNING PHOTORECEPTOR SENSITIVITY

BACKGROUND OF THE INVENTION

The present invention is generally directed to photoresponsive devices, and imaging apparatus and processes thereof. More specifically, the present invention relates to improved photoresponsive devices comprised generally of a photogenerating layer and a transport layer. The present invention provides a process for selecting or fine tuning the sensitivity of photoresponsive devices by preparing and including in the photogenerator layer of the device a mixture of chlorogallium phthalocyanine (ClGaPc) photopigment particles, and which mixture of ClGaPc photopigment particles are the same polymorph but have a different origin or source, and the different source materials possess a different sensitivity.

The photoresponsive devices of the present invention are useful as imaging members in various electrostatographic imaging systems, including those systems wherein electrostatic latent images are formed on the imaging member. Additionally, the photoresponsive devices of the present invention can be irradiated with light, for example, as generated by a known laser, to accomplish, for example, latent image formation by, for example, charged area discharge (CAD) or dark area discharge (DAD) methodologies.

Numerous photoresponsive devices for electrostatographic imaging systems are known including selenium, selenium alloys, such as arsenic selenium alloys; layered inorganic photoresponsive, and layered organic devices. Examples of layered organic photoresponsive devices include those containing a charge transporting layer and a charge generating layer, or alternatively a photogenerator layer. Thus, for example, an illustrative layered organic photoresponsive device can be comprised of a conductive substrate, overcoated with a charge generator layer, which in turn is overcoated with a charge transport layer, and an optional overcoat layer overcoated on the charge transport layer. In a further "inverted" variation of this device, the charge transporter layer can be overcoated with the photogenerator layer or charge generator layer. Examples of generator layers that can be employed in these devices include, for example, charge generator materials such as pigments, selenium, cadmium sulfide, vanadyl phthalocyanine, x-metal free phthalocyanines, dispersed in binder resin, while examples of transport layers include dispersions of various diamines, reference for example, U.S. Pat. No. 4,265,990, the disclosure of which is incorporated herein by reference in its entirety.

There continues to be a need for improved photoresponsive devices, and improved imaging systems utilizing such devices. Additionally, there continues to be a need for photoresponsive devices of varying sensitivity, which devices are economical to prepare and retain their properties over extended periods of time. Furthermore there continues to be a need for photoresponsive devices that permit both normal and reverse copying of black and white as well as full color images, especially in high speed digital printing systems.

PRIOR ART

In U.S. Pat. No. 5,588,991, issued Dec. 31, 1996, and U.S. Pat. No. 5,688,619, issued Nov. 18, 1997, both to Hongo, et al., there is disclosed a process for producing a chlorogallium phthalocyanine crystal comprising mechanically dry-grinding chlorogallium phthalocyanine and subjecting the crystal [to] conversion, the weight ratio of chlorogallium phthalocyanine to the grinding media is set at a range of from ⅕ to 1/1,000. The resulting chlorogallium phthalocyanine crystal excels in the dispersability in a binding resin and the stability in the dispersion.

In U.S. Pat. No. 5,521,306, issued May 28, 1996, to Burt, et al., there is disclosed a process for the preparation of Type V hydroxygallium phthalocyanine which comprises the in situ formation of an alkoxy-bridged gallium phthalocyanine dimer, hydrolyzing said alkoxy-bridged gallium phthalocyanine dimer to hydroxygallium phthalocyanine, and subsequently converting the hydroxygallium phthalocyanine product obtained to Type V hydroxygallium phthalocyanine.

In U.S. Pat. No. 5,472,816, Dec. 5, 1995, to Nukada et al., there is disclosed a halogen-containing hydroxygallium phthalocyanine crystal showing intense diffraction peaks at Bragg angles (2 . . . theta . . . degree . . . +–.0.2.degree) of (1) 7.7, 16.5, 25.1 and 26.6 degrees; (2) 7.9, 16.5, 24.4, and 27.6 degrees; (3) 7.0, 7.5, 10.5, 11.7, 12.7, 17.3, 18.1, 24.5, 26.2, and 27.1 degrees; (4) 7.5, 9.9, 12.5, 16.3, 18.6, 25.1, and 28.3 degrees; or (5) 6.8, 12.8, 15.8, and 26.0 degrees, and an electrophotographic photoreceptor containing the halogen-containing hydroxygallium phthalocyanine crystal as a charge generating material are disclosed. Hydroxygallium phthalocyanine crystals are produced by reacting a gallium trihalide with phthalonitrile or diiminoisoindoline in a halogenated aromatic hydrocarbon solvent, treating the resulting halogenated gallium phthalocyanine with an amide solvent, and hydrolyzing the halogenated gallium phthalocyanine. The photoreceptor exhibits stabilized electrophotographic characteristics.

Also of interest are U.S. Pat. Nos. 5,493,016, 5,456,998, and 5,466,796. The aforementioned references are incorporated in their entirety by reference herein.

The disclosures of each the above mentioned patents are incorporated herein by reference in their entirety. The appropriate components and processes of these patents may be selected for the materials and processes of the present invention in embodiments thereof.

In the devices, imaging apparatuses, and processes of the prior art, various significant problems exist. For example, in the manufacture of photogenerator compounds for the xerographic arts, it is common practice to reproduce a photopigment synthetic procedure as exactly as possible each and every time the process is used in order to manufacture a very consistent target photogenerator compound material and thereby provide the exact photosensitivity demanded by the specifications of a particular printer or copier model. It is known that the synthesis conditions employed, including the solvent used, among other factors, play an irreversible role in imparting to the photogenerator compound so formed certain indelible electrical characteristics which can only moderately be manipulated by subsequent processing steps. The particular printer or copier has electronics and mechanical subsystems which are developed along with the photoreceptor imaging member to achieve a desired image quality. The photoreceptor fabrication conditions, including the particular plant or plants in which manufacturing takes place, can give rise to variations in the photoreceptor's performance in the printer and copier products. Image quality problems can also arise for particular models in field use which may then require changes in photoreceptor photogenerator specifications, or a need to adjust the sensitivity of the photoreceptor, up or down, as required by a particular application, a machine, a developer design change, or a customer requirement. As a consequence of the above described variables, it is advantageous to be able to manufacture photogenerators, and thereby photoreceptors, with variations as required during the lifetime of a given printer or copier design program which allows for minimal variation in the photoreceptor manufacturing conditions. These and other advantages are enabled with the articles, apparatuses, and processes of the present invention.

SUMMARY OF THE INVENTION

Embodiments of the present invention, include:

A process comprising:

forming a first chlorogallium phthalocyanine (ClGaPc) in N-methyl-2-pyrrolidone (NMP) to form a ClGaPc (NMP) Type-I product;

forming a second chlorogallium phthalocyanine in dimethyl sulfoxide (DMSO) to form a ClGaPc (DMSO) Type-I product;

separately dry milling and then wet treating the resulting Type-I products to convert them to a more sensitive Type-II polymorph;

blending the resulting Type-II products together along with a resin and a solvent for the resin to form a coating mixture; and coating the mixture to form a charge generator layer in an electrostatographic imaging article;

An electrostatographic imaging article comprising:

a substrate;

a charge generator layer prepared in accordance with the abovementioned process and overcoated on the substrate; and a charge transport layer overcoated on the charge generator; and An imaging apparatus incorporating the abovementioned imaging article.

These and other embodiments of the present invention are illustrated herein.

DETAILED DESCRIPTION OF THE INVENTION

We discovered that the photosensitivity of final ClGaPc pigment products, such as the Type-II polymorph, can be manipulated or modified by the particular solvent selected and used in the preceding synthesis step of the Type-I polymorph precursor. For example, preparing a ClGaPc Type-I compound in the solvent N-methyl-2-pyrrolidinone (NMP), also known as N-methylpyrrolidone, followed by dry milling and final wet treatment steps, affords a product designated as "ClGaPc (NMP) Type-II pigment" that possesses a lower photosensitivity than the corresponding product designated as "ClGaPc (DMSO) Type-II pigment" made substantially identically as the ClGaPc (NMP) Type-II pigment product except that the solvent used is dimethyl sulfoxide (DMSO) instead of NMP. The ClGaPc Type II pigment originally made in DMSO solvent was measured and found to have a photosensitivity which was too high for certain intended printing machine applications, for example, low or mid-range print volume machines which may not require the highest possible photosensitivity available from ClGaPc Type-II pigment products. This Type-II product also has high charge acceptance, low dark decay and excellent cycling characteristics along with high surface area, as measured by, for example, the known BET method. This product can be readily formulated into a charge generator layer (CGL) with a high degree of dispersion of the ClGaPc pigment in a binder resin. Selective heat treatment of this ClGaPc pigment material can sometimes reduce the sensitivity to the desired value, although the pigment surface area is simultaneously reduced by the heat treatment. The extent of pigment particle surface area reduction can depend, for example, on the severity or extent of heat treatment process. Where the heat treatment is extensive there may result a product with, for example, increased particle size or reduced surface area and the resulting product may be difficult to further process into a highly disperse CGL structure. To reacquire the desired photogenerator pigment dispersability, an additional milling step may be needed. Consequently, this preparative route requires one or two additional steps, for a total of about 4 or 5 steps, for producing ClGaPc pigment particles with satisfactory sensitivity properties if the product is to be suitable for use as the sole pigment in the photogenerator layer.

In contrast, if a batch of ClGaPc Type-I pigment is synthesized from gallium trichloride and 1,3-diiminoisoindoline in NMP as the sole solvent, after dry milling and wet processing, the resulting pigment will have sensitivity which, by itself, may be too low for the desired machine application. This product also has high charge acceptance, low dark decay and excellent cycling characteristics and a high surface area or high BET, and may readily be formulated into a good CGL dispersion.

In embodiments of the present invention, by selecting the appropriate ratio of ClGaPc made in DMSO solvent to ClGaPc made in NMP solvent, the desired photosensitivity value of the resulting blend may be manipulated or adjusted to provide a wide range of required intermediate photosensitivity values. Since no heat treatment step is required in this approach, the maximum surface area may be maintained resulting in the excellent pigment dispersion characteristics when formulating the pigment blend into a CGL coating mixture. Thus, only three process steps are needed to manufacture ClGaPc in the quantity desired and with the required properties.

For machines for which ClGaPc photopigments were originally developed, a desired sensitivity match value is, for example, about $E_{7/8}$=5.5 ergs/cm$^2$. As seen in Table 1, an approximately linear range of sensitivities can be fashioned by blending varying amounts of the two different ClGaPc samples obtained from the two different synthesis solvents. By interpolation, a mixture consisting of about 50 percent by weight of the NMP solvent prepared material and about 50 percent by weight of the DMSO solvent prepared material can provide the desired sensitivity of about $E_{7/8}$=5.5 ergs/cm$^2$.

An additional advantage of the blend approach of the present invention is that, if future sensitivity required by the machine program or imaging device changes from previous specification values, then the blend approach can be readily used to fine-tune the photosensitivity of the CGL pigment material to a new target value. Another advantage of the blend approach is that if one changes the site of the photoreceptor or photoreceptor component manufacture for economic or other business reasons, the blend approach can be readily adapted and used to adjust the relative composition of the blended pigments to fine-tune the photosensitivity of the CGL pigment material to desired values and to compensate for differences arising from other unpredictable variations in a specific manufacturing plant process.

The ability to tune, control, and determine photoreceptor sensitivity by blending of different solvent produced ClGaPc pigment products eliminates the need for an additional heat treatment step and provides ClGaPc pigment products with particles that possess high surface area, afford high dispersability, and have high stability against agglomeration in coating formulations and coating processes. The heat treatment step used previously reduced the photosensitivity of ClGaPc Type II pigment product prepared in dimethylsulfoxide (DMSO) solvent to a lower level to afford material suitable for use in photoreceptor production applications. Thus a negative consequence of the heat treatment step is that it causes the photogenerator pigment particles to stick together more closely which renders the pigment more difficult to disperse uniformly for use in the photoconductive layer coating solution.

The blending of mixtures of the two different solvent produced ClGaPc Type-II pigment products can be accomplished in several different methods. One method is the as-synthesized Type-I products can be blended together to form a uniform mixture and then followed by dry and wet treatment steps of the mixture. A second method involves accomplishing the separate synthesis and dry milling steps followed by wet milling the combined mixture. A third method involves separately processing the different solvent produced Type-I products to Type-II products and then finally blending the resulting separate products to achieve the desired blend ratio in the mixture of the respective Type-II products having the desired sensitivity. The third method is most preferred since production scale products can be evaluated in advance and permit a determination of the most accurate blend ratio required and to minimize systematic blend variation. Blending in the first and second methods at the other earlier stages are similar to each other and are less preferred, but offer the advantage of mixing the pigments while milling the pigment particles to the proper size.

A well known and common practice in the industrial manufacture of photogenerator compounds for the xerographic arts is to perform several large batch syntheses, for example annually, to prepare a stockpile of a target photogenerator compound material. The stockpile provides a sufficient quantity of the photogenerator compound to meet the quantity demands and specifications of a particular printer or copier model and its respective photoreceptor or photoreceptor(s) imaging components, and especially for printer or copier models in customer field use or the so-called "consumables" market. Problems with this scheme include, for example, changes in model use or photoreceptor demand; changes in photoreceptor photogenerator specifications; or a need to adjust the sensitivity of the photoreceptor, up or down, for example, as required by a particular application, machine or developer design change, or customer requirement. These problems can lead to, for example, excess or scrap photogenerator compounds, or alternatively, photogenerator compounds which are unacceptable or inadequate for formulation into a photoreceptor member because of improper photosensitivity properties.

An advantage of the present invention is that the article and processes thereof afford photopigment compositions which can be readily varied or adjusted in photosensitivity properties and provide constant optical properties and as illustrated herein.

An additional advantage of the present invention is that the article and processes thereof afford photopigment compositions which can be readily varied or adjusted in photosensitivity properties in order to accommodate variations which result from manufacturing photoreceptors in different locations as may be desired, for example, for economic or other business reasons.

A further advantage of the present invention is that the article and processes thereof afford photopigment compositions which can be readily varied or adjusted in photosensitivity properties as required in order to accommodate changes which may occur as a copier or printer machine ages in field use, if for example the aging of other electrical components of the machine causes a reduction in image quality.

In embodiments the present invention provides processes comprising, for example:

forming a first chlorogallium phthalocyanine (ClGaPc) in N-methyl-2-pyrrolidinone (NMP) to form a ClGaPc (NMP) Type-I product;

forming a second chlorogallium phthalocyanine in dimethyl sulfoxide (DMSO) to form a ClGaPc (DMSO) Type-I product;

separately dry milling and then wet treating the Type-I products to form respective Type-II products;

blending the Type-II products together along with a resin to form a coating mixture; and coating the mixture to form a photoconductive charge generator layer in an electrostatographic imaging article.

The coating mixture can contain, for example, from about 10 to about 60 weight percent of ClGaPc (NMP) Type-II product, and from about 60 to about 10 weight percent ClGaPc (DMSO) Type-II product, and from about 30 to about 70 weight percent resin. The weight percents of the individual pigments in the mixture are combined or summed to give a total amount of pigment. In embodiments the total weight of pigment in the mixture can be, for example, from about 30 to about 70 weight percent, and about 50 weight percent binder resin. In a preferred embodiment, the coating mixture can contain from about 20 to about 40 weight percent ClGaPc (NMP) Type-II product, from about 40 to about 20 weight percent of the ClGaPc (DMSO) Type-II product, and from about 40 to about 60 weight percent of a resin or resins.

In embodiments, the above mentioned coating mixture can provide, for example, a photoconductive imaging member having an $E_{7/8}$ sensitivity of about 5.5 ergs/cm$^2$. In embodiments, the above mentioned coating mixture can have, for example, from about 25 to about 30 weight percent ClGaPc (NMP) Type-II product, from about 25 to about 30 weight percent of the ClGaPc (DMSO) Type-II product, and from about 40 to about 50 weight percent of a resin and provide a photoconductive imaging member with an $E_{7/8}$ sensitivity of about 5.5 ergs/cm$^2$. In embodiments, the resulting charge generator layer in a operative photoconductive imaging member can have a $E_{7/8}$ photosensitivity measured as 88% discharge, of from about 4.5 to about 7.0 ergs/cm$^2$.

The resin or resins used in formulating the coating mixture can be, for example, poly(vinyl butyral), poly(vinyl carbazole), polyesters, polycarbonates, polyacrylates, polyacrylics, polymers or copolymers of vinyl chloride and vinyl acetate, vinylchloride-vinylacetate-malic acid terpolymers, polystyrene, and combinations or mixtures thereof. Other suitable resins can include, for example, phenoxy resins, polyurethanes, poly(vinyl alcohol), polyacrylonitrile, and the like polymers or copolymers, and mixtures thereof. Copolymers, block copolymers, terpolymers, block terpolymers, and the like polymeric materials and mixtures thereof can be used as the binding resin. The compounding weight ratio of the charge generating material to the binder resin is preferably from about 40:1 to about 1:4, and more preferably from about 20:1 to about 1:2. If the ratio of the charge generating material is too high, the stability of the coating liquid is decreased, and conversely, if it is too low, the sensitivity of the resulting device is lowered. For these reasons, the above-mentioned ranges are preferred. Coating processes and methods include but are not limited to, for example, blade coating, wire bar coating, spray coating, dip coating, bead coating, and curtain coating.

The dry milling can be accomplished, for example, with a vibration-type mill, and the wet treating can be accomplished, for example, with a ball mill in a suitable solvent, such as DMSO.

In embodiments, the present invention provides a process comprising:

- forming a chlorogallium phthalocyanine in DMSO to form a ClGaPc (DMSO) Type-I product;
- dry milling and then wet treating the resulting product to form a ClGaPc (DMSO) Type-II product;
- blending the resulting Type-II product with second photogenerator compound having a lower photosensitivity than the ClGaPc (DMSO) Type-II product in a resin or resin mixture to form a coating mixture; and
- coating the mixture to form a charge generator layer in an electrostatographic imaging article.

In embodiments, the above mentioned coating mixture can contain, for example, of from about 30 to about 70 weight percent of a mixture of the Type-II product and a second photogenerator compound and which weight percent is based on the combined weight of the photogenerator compounds and the resin. The second photogenerator compound can be, for example, metal phthalocyanines, metal-free phthalocyanine, alkoxygallium phthalocyanines, and mixtures thereof, such as copper phthalocyanines, vanadyl phthalocyanines, metal-free phthalocyanines or X-free phthalocyanine, where X is a halogen; alkoxygallium phthalocyanines, and the like phthalocyanine compounds, reference for example, the above U.S. Patents incorporated by reference.

In embodiments, the present invention provides a process comprising:

- forming a chlorogallium phthalocyanine in NMP to form ClGaPc (NMP) Type-I product;
- dry milling and then wet treating the product to form ClGaPc (NMP) Type-II product;
- blending the resulting product with a resin to form a coating mixture; and
- coating the mixture to form a charge generator layer in a electrostatographic imaging article.

In embodiments, the present invention can also provide an electrostatographic imaging article comprising:

- a substrate;
- a charge generator layer prepared in accordance with the above mentioned preparative processes and which layer is overcoated on the substrate; and
- a charge transport layer overcoated on the charge generator, and optionally a protective overcoat or optionally an anticurl back coating layer.

The imaging article can have, for example, an $E_{1/2}$ photosensitivity of from about 1.5 to about 3.0 and an $E_{7/8}$ photosensitivity of from about 4.5 to about 7.0 ergs/cm$^2$. In a preferred embodiment the article can have, for example, an $E_{1/2}$ photosensitivity of from about 2.2 to about 2.5 and an $E_{7/8}$ photosensitivity of from about 5.0 to about 6.0 ergs/cm. The charge generator layer prepared with the pigments and processes of the present invention contain little or no residual solvent residue, for example, from about 0 to about 100 parts per million of DMSO and, for example, from about 0 to about 100 parts per million of NMP. In an embodiment the article can have, for example, a charge generator layer which contains, for example, from about 25 to about 30 weight percent ClGaPc (NMP) Type-II product, from about 25 to about 30 weight percent ClGaPc (DMSO) Type-II product, and from about 40 to about 60 weight percent resin or resin mixture.

The ClGaPc (DMSO) Type-II product preferably has an average diameter particle size, for example, of from about 50 to about 100 nanometers and the ClGaPc (NMP) Type II product can have, for example, an average diameter particle size of from about 25 to about 50 nanometers. In the present invention the photogenerator compound synthesis in NMP gives smaller final particles compared to the comparable synthesis in DMSO, reference the synthesis examples and tabulated results. It is also recognized by those skilled in the art that photogenerator compounds with small or minimized particle size are expected to provide improved dispersion characteristics in a coated photogenerator layer which in turn provides maximum sensitivity obtainable for that material and as also limited by its processing history, for example, reaction conditions, residual solvent(s) or impurities, polymorph type and polymorph contamination, and the like considerations. The ClGaPc (DMSO) Type-II product preferably has a particle surface area, for example, of from about 40 to about 70 square meters per gram and the ClGaPc (NMP) Type-II product preferably has a particle surface area of from about 40 to about 70 square meters per gram. The charge generator layer preferably has a thickness, for example, of from about 0.1 to about 0.5 micrometers.

In embodiments the present invention provides an imaging apparatus comprising: a known electrostatographic imaging apparatus which includes the above mentioned imaging member or article prepared in accordance with the processes of the present invention, for example, an electrostatographic imaging article comprising: a substrate; a charge generator layer prepared by the process of forming a first chlorogallium phthalocyanine (ClGaPc) in N-methyl-2-pyrrolidone (NMP) to form a ClGaPc (NMP) Type-I product; forming a second chlorogallium phthalocyanine in dimethyl sulfoxide (DMSO) to form a ClGaPc (DMSO) Type-I product; separately dry milling and then wet treating the resulting Type-I products to convert them to a more sensitive Type-II polymorph; blending the resulting Type-II products together along with a resin and a solvent for the resin to form a coating mixture; and coating the mixture to form a charge generator layer overcoated on the substrate; and a charge transport layer overcoated on the charge generator.

The imaging member or article can include a substrate, for example, an endless photoconductive member, such as a drum, belt, or drelt, having an inner layer, a charge retentive outer layer, and a conductive electrode layer between the inner and outer layers. In embodiments the imaging process and apparatus can include depositing charged marking particles on an outer surface of the photoconductive member and held in relative contact therewith; a light source for selectively exposing the photoconductive member to light to produce both exposed and unexposed regions therein and to cause the collapse of the electric field in the exposed regions; and an image receiver member, spaced apart from the outer surface of the photoconductive member, for receiving the marking particles, the image receiving member having an electrical bias applied thereto to neutralize an electric field present in the gap between the image receiver member and the exposed regions of the photoconductive member.

In embodiments the present invention provides an electrophotographic imaging member comprising:

a support, and at least one photoconductive layer comprising photoconductive particles, wherein the photoconductive particles in the photoconductive layer are a mixture of ClGaPc Type-II pigment particles, where:

i) from about 90% to about 10% by weight of the ClGaPc Type-II pigment particles are obtained from a synthesis of ClGaPc in NMP solvent, and ii) from about 10% to about 90% by weight of the ClGaPc Type II pigment particles are obtained from a synthesis of ClGaPc in DMSO solvent.

In embodiments the present invention provides an electrophotographic imaging member comprising:

a support;

a charge generating layer having a binder, a mixture of different solvent prepared ClGaPc Type II pigment particles; and a charge transport layer.

The present invention relates to blending photogenerator compounds of the same composition, such as particles from two different batches of the same polymorph of ClGaPc but which different batch ClGaPc compounds have different photosensitivities which when appropriately mixed can achieve desired sensitivities for a certain photogenerator application. As an example, ClGaPc synthesis in dimethyl sulfoxide (DMSO) as the reaction solvent can produce a ClGaPc product which can be too photosensitive for certain applications. So an extra step, such as post synthesis heat treatment can used to reduce the final pigment's sensitivity to the required level. Heat treatment is known to cause a reduction in surface area of the pigment particles and which surface area reduction hinders the pigment's particle dispersability in a photogenerator layer matrix. Heat treating is disfavored because it tends to be a highly variable process, that is, heating under a given set of conditions can cause different drops in sensitivity for different batches. It is well known that differences in the synthetic process, especially using a different solvent, can impart undesirable characteristics to the product. It has been found that the photosensitivity of the final ClGaPc can be adjusted by the solvent used in the synthesis step, for example, NMP solvent gives a controllably lower sensitivity ClGaPc Type-II product compared to the controllably higher sensitivity of the ClGaPc Type-II product prepared in DMSO. Other useful physical and electrical properties of both the NMP and the DMSO prepared ClGaPc Type-II pigments in photogenerator layers are excellent, reference for example, the working Examples and as illustrated herein.

The chlorogallium phthalocyanine Type-I used as a starting material to prepare the Type-II pigment products in the present invention can be produced, for example, by reacting 1,3-diiminoisoindoline and gallium trichloride with heating in an organic solvent, such as either DMSO or NMP. The resulting chlorogallium phthalocyanine Type-I products have peaks at least at 9.3°, 10.9°, 13.3°, 18.7°, 20.3°, 26.9°, 28.9° and 33.1° of the Bragg angle relative to Cu-K alpha character X-ray (2.theta. +/−0.2°) with the largest peak at 26.90. Other solvents such as chloronaphthalene, ethylene glycol, quinoline, sulfolanes, and the like solvents give products with inferior sensitivities but which solvents may be considered as a reaction solvent or cosolvent for preparing pigments with lower sensitivities for the purpose of blending with pigments with higher sensitivities to achieve pigment blends and photosensitive imaging articles with intermediate sensitivities or tuned sensitivities. Particularly preferred solvents are dimethyl sulfoxide (DMSO) and N-methyl-2-pyrrolidone (NMP).

Chlorogallium phthalocyanine obtained by these synthetic processes can be mechanically dry-ground according to the present invention. Using a grinder for fine grinding by incorporating grinding media in the interior of the grinding vessel such as a vibration mill, a planetary ball mill, a sand mill, an attritor, a ball mill, and the like devices, the chlorogallium phthalocyanine product is preferably dry-ground with a weight ratio or parts ratio of chlorogallium phthalocyanine pigment to grinding media in a range of, for example, from about 1:5 to about 1:100. The time period of pulverization can be, for example, from about 1 to 300 hours, and where crystal conversion occurs and obtains the intended chlorogallium phthalocyanine crystal of low crystallinity and designated as Type-IIA.

A vibration mill is a preferred and most effective grinder of the above-mentioned grinders and can provide a high grind efficiency. As the raw material for the grinding media, any known materials such as glass, alumina, zirconia, steel, stainless steel, carbon steel, chromium steel, silicon nitride, nylon, and polyurethane can be used. The shape of the grinding media which can be used can be a known shape such as a spherical, circular or disc, globular, rod, or cylindrical form. The weight ratio or parts ratio of chlorogallium phthalocyanine to the grinding media can be from about 1:5 to about 1:100, and preferably from about 1:5 to about 1:20. If the weight ratio of chlorogallium phthalocyanine to the grinding media is greater than about 1:5, the grinding efficiency is decreased and requires a much longer grind period and thus is not preferred for high production efficiency. Moreover, even when the grind period is extended, the fine grind does apparently not produce any additional particle size reduction and does not provide any improvement in sensitivity. Conversely, if the weight ratio is less than about 1 :100, the recovery of the crystal-converted chlorogallium phthalocyanine is decreased and importantly wearing of the grinding media is increased, which wear can contaminate the ClGaPc product and can cause the resulting image quality of printed materials to be adversely affected. The converted chlorogallium phthalocyanine Type-IIA crystal preferably has an average particle size of not more than about 0.20 micrometers, and particularly from about 0.01 to about 0.20 micrometers, and can be achieved by adjusting the grinding period. If the average diameter particle size exceeds about 0.20 micrometers, the sensitivity of the resulting material is insufficient and the dispersability is decreased and may result in greater printed image defects.

The chlorogallium phthalocyanine which has been converted to Type-IIA by the process of the present invention has low crystallinity with broad main diffraction peaks at least at 7.3°, 16.5°, 25.4° and 28.1° of the Bragg angle relative to Cu-K alpha character X ray (2 theta +/−0.2°). The low crystallinity ClGaPc pigment can be further crystallized to a higher crystallinity form, designated as Type-II, by a wet treatment step in which the pigment is milled in a solvent such as dimethyl sulfoxide (DMSO) using glass beads and a mill, such as a roll mill. The chlorogallium phthalocyanine Type-I product modified by the process of the present invention has higher crystallinity with main diffraction peaks at least at 7.2°, 16.5°, 21.6°, 23.5°, 25.3°, 28.1°, 29.60° and 38.5° of the Bragg angle relative to Cu-K alpha character X ray (2 theta +/−0.2°).

The film thickness of the charge generating layer is preferably from about 0.01 to about 5 micrometers, and more preferably from about 0.03 to about 2 micrometers. The charge generating layer can be overcoated with a charge transport layer and can be composed of any suitable charge transport material and any suitable film-forming resin. Examples of suitable film-forming resin or resins include, but are not limited to, polyarylates, polycarbonates, polyallylates, polystyrenes, polyesters, styrene-acrylonitrile copolymers, polysulfones, polymethacrylates, styrene-methacrylate copolymers, polyolefins, and the like materials. Of these, polycarbonates are particularly suitable in terms of durability. The compounding weight ratio of the charge transport material to the film-forming resin is preferably from about 5:1 to about 1:5, and more preferably from about 3:1 to about 1:3. If the ratio of the charge material is too high, the mechanical strength of the charge transport layer is decreased and, conversely, if it is too low, sensitivity of the device is lowered. For these reasons, the above-mentioned ranges are preferable. If the charge transport material has a film-forming ability, the film forming resin can be omitted.

The charge transport material layer can be formed by dissolving the charge transport material and the film-forming resin in an appropriate solvent, followed by coating application, and it is preferable to form the layer in such a manner that the film thickness preferably is in the range of from about 5 to about 50 micrometers, and more preferably from about 10 to about 40 micrometers.

Methods for applying the charge transporting layer include the above mentioned methods for applying the charge generating layer. If the photosensitive layer has a single layer construction, the photosensitive material can be described as chlorogallium phthalocyanine crystal and the single layer also contains charge transport material dissolved in the film forming resin or resins component. Any suitable charge transport material can be used and the film forming resin can be the same or similar material to those mentioned above. The single photosensitive layer can be formed by any of the above-mentioned coating methods. It is preferable to set the compounding weight ratio of the charge transport material to the film forming resin at the range from about 1:20 to about 5:1, and the compounding weight ratio of the chlorogallium phthalocyanine to the charge transport material at the range from about 1:10 to about 10:1.

An undercoat layer can optionally be provided between the photosensitive layer and the substrate. The undercoat layer is effective for preventing the injection of unnecessary electric charge from the substrate, and has a function of enhancing charging properties. Also, it has a function of enhancing the adhesion between the photosensitive layer and the substrate.

In addition, to improve photoreceptor wear resistance, a protective overcoat layer can be provided on the photosensitive layer, or the transport layer, as appropriate for the particular device configuration. Suitable overcoat materials include those resins described above.

The resulting electrophotographic photoreceptors can be effectively used in an electrophotographic copying machine, and it is also applicable to, for example, laser beam printers, LED printers, CRT printers, microfilm readers, plain paper facsimiles, and the like electrophotographic printing system.

The chlorogallium phthalocyanine crystals obtained by the process of the present invention can provide an electrophotographic photoreceptor exhibiting the desired level of photosensitivity, excellent electrophotographic characteristics, and excellent dispersability, and having excellent image quality without fogging and black spots by incorporating the crystals into a photosensitive layer as a charge generating material. Furthermore, since the processes for producing chlorogallium phthalocyanine crystals of the present invention can be carried out using the same equipment and the resulting crystals possess the same excellent characteristics with respect to their ease of dispersability in a photogenerator layer matrix and the crystals may be mixed in any ratio desired without any negative consequences, the mixed crystal system composition may be chosen as required to attain any desired level of photosensitivity within the range defined by the respective ClGaPc pigment products when formulated into a photoreceptor device alone.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Chlorogallium Phthalocyanine in DMSO (ClGaPc, Type-I ) In a 2 L round bottomed flask, 20 parts of dimethyl sulfoxide (DMSO), 4.0 parts of 1,3-diiminoisoindoline and 1.0 parts of gallium trichloride were mixed. The mixture was reacted at 160 ° C. for 5 hours under a nitrogen atmosphere. Thereafter, the product was filtered off, washed with 3 times 10 parts DMSO and then with 3 times 10 parts deionized water, and the wet cake was then dried to obtain 3.0 parts of chlorogallium phthalocyanine. The powder X-ray diffraction identified the resulting product as chlorogallium phthalocyanine Type-I when compared to known standards, having peaks at least at 9.3°, 10.9°, 13.3°, 18.7°, 20.3°, 26.9°, 28.90° and 33.1° of the Bragg angle relative to Cu-K alpha character X-ray (2.theta. +/−0.2°), with the largest peak at 26.9°.

EXAMPLE II

Preparation of Chlorogallium Phthalocyanine in DMSO (ClGaPc, Type-I) In a 2 L round bottomed flask, 20 parts of dimethyl sulfoxide (DMSO), 4.0 parts of 1,3-diiminoisoindoline and 1.0 parts of gallium trichloride were mixed. The mixture was reacted at 160 ° C. for 5 hours under a nitrogen atmosphere. Thereafter, the product was filtered off, washed with 3 times 10 parts N,N-dimethylformamide (DMF) and then with 3 times 10 parts deionized water, and the wet cake was then dried to obtain 3.0 parts of chlorogallium phthalocyanine. The powder X-ray diffraction identified the resulting product as chlorogallium phthalocyanine Type-I when compared to known standards, having peaks at least at 9.3°, 10.9°, 13.3°, 18.7°, 20.3°, 26.9°, 28.9° and 33.1° of the Bragg angle relative to Cu-K alpha character X-ray (2.theta. +/−0.2°), with the largest peak at 26.9°. This example also demonstrates that the work up or wash solvent, here DMF or water, is not believed critical to the quality or efficacy of the resulting product.

EXAMPLE III

Preparation of Chlorogallium Phthalocyanine in NMP (ClGaPc Type-I) In a 2 L round bottomed flask, 20 parts of N-methyl-2-pyrrolidinone (NMP), 4.0 parts of 1,3-diiminoisoindoline and 1.0 parts of gallium trichloride were mixed. The mixture was reacted at 200° C. for 5 hours under a nitrogen atmosphere. Thereafter, the product was filtered off, washed 3 times with 10 parts DMSO and then 3 times with 10 parts deionized water, and then the wet cake was dried to obtain 2.2 parts of chlorogallium phthalocyanine. The powder X-ray diffraction identified the resulting product as chlorogallium phthalocyanine Type-I when compared to known standards, having peaks at least at 9.3°, 10.9°, 13.3°, 18.7°, 20.3°, 26.9°, 28.9° and 33.1° of the Bragg angle relative to Cu-K alpha character X-ray (2.theta. +/−0.2°), with the largest peak at 26.9°.

EXAMPLE IV

Preparation of Chlorogallium Phthalocyanine (DMSO) Type-IIA To a 500 mL polypropylene bottle containing 500 grams of ½ inch cylindrical alumina media was added 50 grams of the Type-I polymorph ClGaPc obtained in Example I above. The bottle was placed on a vibration mill and agitated for 14 days, after which time the ClGaPc was isolated and determined to be the low crystallinity Type-IIA polymorph by powder X-ray diffraction, having broad peaks primarily at 7.3°, 16.5°, 25.4° and 28.1° of the Bragg angle relative to Cu-K alpha character X-ray (2.theta. +−0.2°).

EXAMPLE V

Preparation of Chlorogallium Phthalocyanine (DMSO) Type-IIA To a 500 mL polypropylene bottle containing 500 grams of ½ inch cylindrical alumina media was added 50 grams of the Type-I polymorph ClGaPc obtained in Example II above. The bottle was placed on a vibration mill and agitated for 14 days, after which time the ClGaPc was isolated and determined to be the low crystallinity Type-IIA polymorph by powder X-ray diffraction, having broad peaks primarily at 7.3°, 16.5°, 25.4° and 28.1° of the Bragg angle relative to Cu-K alpha character X-ray (2.theta. +/−0.2°).

EXAMPLE VI

Preparation of Chlorogallium Phthalocyanine (NMP) Type-IIA To a 500 mL polypropylene bottle containing 500 grams of ½ inch cylindrical alumina media was added 50 grams of the Type-I polymorph ClGaPc obtained in Example III above. The bottle was placed on a vibration mill and agitated for 14 days, after which time the ClGaPc was isolated and determined to be the low crystallinity Type-IIA polymorph by powder X-ray diffraction, having broad peaks primarily at 7.3°, 16.5°, 25.4° and 28.1° of the Bragg angle relative to Cu-K alpha character X-ray (2.theta. +/−0.2°).

EXAMPLE VII

Preparation of Chlorogallium Phthalocyanine (DMSO) Type-II To a 120 mL glass bottle containing 60 grams of ¼ inch glass beads was added 3 grams of the Type-IIA ClGaPc obtained in Example IV above and 35 grams of DMSO. The bottle was placed on a roll mill for a period of approximately 24 hours, after which time the resulting form of ClGaPc was isolated by filtration. The ClGaPc was washed with water and dried to about 2.7 grams of the high crystallinity Type-II polymorph characterized by having peaks at least at 7.2°, 16.5°, 21.6°, 23.5°, 25.3°, 28.1°, 29.6° and 38.5° of the Bragg angle relative to Cu-K alpha character X-ray (2.theta. +/−0.2°), with the largest peak at 28.1°.

EXAMPLE VIII

Preparation of Chlorogallium Phthalocyanine (DMSO) Type-II To a 120 mL glass bottle containing 60 grams of ¼ inch glass beads was added 3 grams of the Type-IIA ClGaPc obtained in Example V above and 35 grams of DMSO. The bottle was placed on a roll mill for a period of approximately 24 hours, after which time the resulting form of ClGaPc was isolated by filtration. The ClGaPc was washed with water and dried to deliver about 2.7 grams of the high crystallinity Type-II polymorph characterized by having peaks at least at 7.2°, 16.5°, 21.6°, 23.5°, 25.3 °, 28.1°, 29.6° and 38.5° of the Bragg angle relative to Cu-K alpha character X-ray (2.theta. +/−0.2°), with the largest peak at 28.1°.

EXAMPLE IX

Preparation of Chlorogallium Phthalocyanine (NMP) Type-II To a 120 mL glass bottle containing 60 grams of ¼ inch glass beads was added 3 grams of the Type-IIA ClGaPc obtained in Example VI above and 35 grams of DMSO. The bottle was placed on a roll mill for a period of approximately 24 hours, after which time the resulting form of ClGaPc was isolated by filtration. The ClGaPc was washed with water and dried to deliver about 2.7 grams of the high crystallinity Type-II polymorph characterized by having peaks at least at 7.2°, 16.5°, 21.6°, 23.5°, 25.3°, 28.1°, 29.60 and 38.5° of the Bragg angle relative to Cu-K alpha character X-ray (2.theta. +/−0.2°), with the largest peak at 28.1°.

EXAMPLE X

Large Scale (Pilot Plant) Preparation of Chlorogallium Phthalocyanine in DMSO (ClGaPc, Type-I ) In a 20 gallon glass lined reactor, 20 parts of dimethyl sulfoxide (DMSO), 4.0 parts of 1,3-diiminoisoindoline and 1.0 parts of gallium trichloride were mixed. The mixture was reacted at 160° C. for 5 hours under a nitrogen atmosphere. Thereafter, the product was filtered off, washed 3 times with 10 parts DMSO and then 3 times with 10 parts deionized water, and the wet cake was then dried to obtain 3.0 parts of chlorogallium phthalocyanine. The powder X-ray diffraction identified the resulting product as chlorogallium phthalocyanine Type-I when compared to known standards, having peaks at least at 9.3°, 10.9°, 13.3°, 18.7°, 20.3°, 26.9°, 28.9° and 33.1° of the Bragg angle relative to Cu-K alpha character X-ray (2.theta. +/−0.2°), with the largest peak at 26.9°. The average particle size of the chlorogallium phthalocyanine pigment particles were determined by optical microscopy to be about 25 to 50 micrometers.

EXAMPLE XI

Large or Pilot Plant Scale Preparation of Chlorogallium Phthalocyanine in NMP (ClGaPc Type-I) In a 20 gallon glass lined reactor, 20 parts of N-methyl-2-pyrrolidinone (NMP), 4.0 parts of 1,3-diiminoisoindoline and 1.0 parts of gallium trichloride were mixed. The mixture was reacted at 200° C. for 5 hours under a nitrogen atmosphere. Thereafter, the product was filtered off, washed 3 times with 10 parts N,N-dimethylformamide (DMF) and then 3 times with 10 parts deionized water, and the wet cake was then dried to obtain 2.2 parts of chlorogallium phthalocyanine. The powder X-ray diffraction identified the resulting product as chlorogallium phthalocyanine Type-I when compared to known standards, having peaks at least at 9.3°, 10.9°, 13.3°, 18.7°, 20.3°, 26.9°, 28.9° and 33.1° of the Bragg angle relative to Cu-K alpha character X-ray (2.theta. +/−0.2°), with the largest peak at 26.9°. The average particle size of the chlorogallium phthalocyanine pigment particles were determined by optical microscopy to be about 25 to 100 micrometers, with additional rod shaped particles up to 50 micrometers in length.

EXAMPLE XII

Preparation of Chlorogallium Phthalocyanine (DMS0) Type-IIA To a Sweco brand vibration mill containing 36 kg of ½ inch cylindrical alumina media was added 4 kg of the Type-I polymorph ClGaPc obtained in Example X above. The vibration mill was run continuously for 10 days, after which time the ClGaPc was isolated and determined to be the low crystallinity Type-IIA polymorph by powder X-ray diffraction, having broad peaks primarily at 7.3°, 16.5°, 25.4° and 28.1° of the Bragg angle relative to Cu-K alpha character X-ray (2.theta. +/−0.2°).

EXAMPLE XIII

Preparation of Chlorogallium Phthalocyanine (NMP) Type-IIA To a Sweco brand vibration mill containing 36 kg of ½ inch cylindrical alumina media was added 4 kg of the Type-I polymorph ClGaPc obtained in Example XI above. The vibration mill was run continuously for 10 days, after which time the ClGaPc was isolated and determined to be the low crystallinity Type-IIA polymorph by powder X-ray diffraction, having broad peaks primarily at 7.3°, 16.5°, 25.4° and 28.1° of the Bragg angle relative to Cu-K alpha character X-ray (2.theta. +/−0.2°).

EXAMPLE XIV

Preparation of Chlorogallium Phthalocyanine (DMSO) Type-II To a 20 L polypropylene carboy containing 12 kg of ¼ inch glass beads was added 1.05 kg of the Type-IIA ClGaPc obtained in Example XII above and 12 kg of DMSO. The carboy was placed on a roll mill for a period of approximately 24 hours, after which time the resulting form of ClGaPc was isolated by filtration. The ClGaPc was washed with water and dried to deliver about 1.0 kg of the high crystallinity Type-II polymorph characterized by having peaks at least at 7.2°, 16.5°, 21.6°, 23.5°, 25.3°, 28.1°, 29.60 and 38.5° of the Bragg angle relative to Cu-K alpha character X-ray (2.theta. +/−0.2°), with the largest peak at 28.1°. The average particle size of the chlorogallium phthalocyanine pigment particles determined by transmission electron microscopy were in the range of about 50 to 100 micrometers.

EXAMPLE XV

Preparation of Chlorogallium Phthalocyanine (NMP) Type-II To a 20 L polypropylene carboy containing 12 kg of ¼ inch glass beads was added 1.05 kg of the Type-IIA ClGaPc obtained in Example XIII above and 12 kg of DMSO. The carboy was placed on a roll mill for a period of approximately 24 hours, after which time the resulting form of ClGaPc was isolated by filtration. The ClGaPc was washed with water and dried to deliver about 1.0 kg of the high crystallinity Type-II polymorph characterized by having peaks at least at 7.2°, 16.5°, 21.6°, 23.5°, 25.3°, 28.1°, 29.6° and 38.5° of the Bragg angle relative to Cu-K alpha character X-ray (2.theta. +/−0.2°), with the largest peak at 28.1°. The average particle size of the chlorogallium phthalocyanine pigment particles determined by transmission electron microscopy were in the range of about 25 to 50 micrometers.

EXAMPLE XVI

Preparation of Heat Treated of Chlorogallium Phthalocyanine (DMSO) Type-II A sample of ClGaPc Type-II obtained in Example XIV above was placed in a lab oven and heated at 140° C. under vacuum (−29 inches of mercury) for 3 days, after which it was characterized as still having peaks at least at 7.2°, 16.5°, 21.6°, 23.5°, 25.3°, 28.1°, 29.6° and 38.5° of the Bragg angle relative to Cu-K alpha character X-ray (2.theta. +/−0.2°), with the largest peak at 28.1°. Changes observed in the pigment's surface area and electrical properties are listed in Table 2.

EXAMPLE XVII

Preparation of Heat Treated of Chlorogallium Phthalocyanine (DMSO) Type-II A sample of ClGaPc Type-II obtained in Example XIV above was placed in a lab oven, heated at 160° C. for 15 hours at atmospheric pressure, then characterized as still having peaks at least at 7.2°, 16.5°, 21.6°, 23.5°, 25.3°, 28.1°, 29.6° and 38.5° of the Bragg angle relative to Cu-K alpha character X-ray (2.theta. +/−0.2°), with the largest peak at 28.1°. Changes observed in the pigment's surface area and electrical properties are listed in Table 2.

EXAMPLE XVIII

Preparation of a Photoreceptor Device Containing Mixed Type-II Chlorogallium Phthalocyanines A ClGaPc dispersion was prepared by ball milling a 0.2 gram (g) mixture of ClGaPc Type-II pigments (0.05 g pigment obtained in Example XV with 0.15 g of pigment obtained in Example XIV), 0.159 g of vinylchloride-vinylacetate-maleic acid terpolymer, 4.72 g of p-xylene and 2.33 g of n-butyl acetate in a 30 mL bottle containing 70 grams of ⅛ inch stainless steel balls. The bottle was put on a roll mill and milled for 1 day. The resulting ClGaPc dispersion was coated onto an aluminized MYLAR® film,.which was previously coated with a 0.1 micrometer silane layer, using a wire roll. The coated device was dried at 100° C. for 10 minutes. The optical density of the dry ClGaPc charge generator layer was about 1.0 at the wavelength of 780 nanometers. A charge transport solution was prepared by dissolving 2.7 g of N,N'-diphenyl-N,N'-bis(3-methyl phenyl)-1,1'-biphenyl-4,4'-diamine, and 4.05 g of polycarbonate in 30.8 g of monochlorobenzene. The solution was coated onto the above ClGaPc generator layer using a 7 mil film applicator. The charge transporting layer thus obtained was dried at 115° C. for 60 minutes to provide a final thickness of about 17 micrometers. This provided an electrophotographic photoreceptor with a photosensitivity consistent with the blend ratio of the constituent ClGaPc Type II pigments, as seen in Table 1.

EXAMPLE XIX

Preparation of a Photoreceptor Device Containing Mixed Type-II Chlorogallium Phthalocyanines An electrophotographic photoreceptor was prepared as in Example XVIII with the exception that a charge generating material of a 0.2 g mixture of ClGaPc Type-II pigments consisting of 0.10 grams pigment obtained in Example XV with 0.10 grams of pigment obtained in Example XIV was selected. This gave an electrophotographic photoreceptor with photosensitivity consistent with the blend ratio of the constituent ClGaPc Type-II pigments, as seen in Table 1.

EXAMPLE XX

Preparation of a Photoreceptor Device Containing Mixed Type-II Chlorogallium Phthalocyanines An electrophotographic photoreceptor was produced in Example XVIII with the exception that a charge generating material of a 0.2 gram mixture of ClGaPc Type-II pigments consisting of 0.15 grams pigment obtained in Example XV with 0.05 grams of pigment obtained in Example XIV was selected. This provided an electrophotographic photoreceptor with photosensitivity consistent with the blend ratio of the constituent ClGaPc Type-II pigments, as seen in Table 1.

Table 1 shows a comparison of photoreceptor devices prepared using blended pigments products of the present invention with those devices prepared using the constituent pigment materials alone. It is readily apparent that a range of intermediate sensitivities can be obtained.

TABLE 1

Electrical Evaluation of Photoreceptors with Type-II (T-II) ClGaPc Pigments Prepared from NMP, DMSO, or Mixtures Thereof.

| Weight % ClGaPc (from NMP) | Weight % ClGaPc (from DMSO) | ClGaPc T-II Preparation Example | Device Preparation Example | Dark Decay[5] | $E_{1/2}$ (ergs/cm$^2$) | $E_{7/8}$ (ergs/cm$^2$) |
|---|---|---|---|---|---|---|
| 0 | 100 | XIV | Comparative I | 7 | 2.0 | 4.3 |
| 25 | 75 | Both XIV + XV | XVIII | 9 | 2.2 | 5.0 |
| 50 | 50 | Both XIV + XV | XIX | 14 | 2.4 | 5.4 |
| 75 | 25 | Both XIV + XV | XX | 17 | 2.5 | 5.7 |
| 100 | 0 | XV | Comparative II | 8 | 2.6 | 6.1 |

[5]Dark Decay is Volts dark discharge in 0.5 seconds, to give Vddp.

Photosensitivity of ClGaPc (DMSO) Type-II with Heat Treatment As seen in Table 2, the ClGaPc sample synthesized in DMSO and converted to the Type-II polymorh as described in Example XIV, and without any heat treatment has a BET value of 42 m$^2$/g and sensitivity greater than desired. Heat treating this sample (XIV) as described in Examples XVI and XVII results in reduced total surface areas of the pigment particle samples as seen in the lower BET values, along with at least partially decreased sensitivities. Table 2 also shows reference pigment products obtained from production processes which included heat treatments necessary to attain the required decreased sensitivities. A larger value for $E_{1/2}$ or $E_{7/8}$ indicates more energy is required for that amount of discharge of the photoreceptor device (½ or ⅞ discharge respectively) and so that device is less photosensitive.

TABLE 2

Comparison of ClGaPc Type-I Pigments Prepared in DMSO

| ClGaPc Type-II Source | Heat Treated | ClGaPc Type-II Example | BET[4] | Device Preparation Example | Dark Decay[5] | $E_{1/2}$ (ergs/cm$^2$) | $E_{7/8}$ (ergs/cm$^2$) |
|---|---|---|---|---|---|---|---|
| XIV | No | XIV | 42 | Comparative I | 7 | 2.0 | 4.3 |
| XIV | Yes[2] | XVI | 36 | Comparative III | 6 | 2.3 | 5.0 |
| XIV | Yes[3] | XVII | 33 | Comparative IV | 5 | 2.3 | 5.6 |
| Production | Yes | Reference 1[1] | 46 | Comparative VIII | 5 | 2.2 | 5.2 |
| Production | Yes | Reference 2[1] | 38 | Comparative IX | 5 | 2.5 | 5.8 |

Key:
[1]These are representative values for reference standard samples which provide satisfactory performance in photoreceptor application(s) after a heat treatment step.
[2]ClGaPc from Example XIV heat treated for 3 days at 140° C., under vacuum (29 inches Hg)
[3]ClGaPc from Example XIV heat treated for 15 hours at 160° C., at atmospheric pressure
[4]BET is surface area in m$^2$/g
[5]Dark Decay is Volts dark discharge in 0.5 seconds, to give Vddp.

Reproducible Photosensitivity of ClGaPc (DMSO) Type-II and ClGaPc (NMP) Type-II Prepared on Small(Lab) and Large(Pilot) Scales. As seen in Table 3, the ClGaPc samples synthesized in DMSO on different scales and described in Examples VII, VIII and XIV consistently have sensitivities greater than desired. Table 3 also shows that ClGaPc samples synthesized in NMP at different scales and described, for example, in Examples IX and XV consistently have sensitivities lower than desired.

TABLE 3

Comparison of Lab Scale and Pilot Plant Scale Syntheses of ClGaPc.

| Type-I Synthesis Source | ClGaPc Synthesis Scale | ClGaPc Type-II Example | BET[4] | Device Preparation Example | Dark Decay[5] | $E_{1/2}$ (ergs/cm$^2$) | $E_{7/8}$ (ergs/cm$^2$) |
|---|---|---|---|---|---|---|---|
| DMSO | 2 L | VII | 44 | Comparative V | 8 | 2.0 | 4.1 |
| DMSO | 2 L | VIII | 50 | Comparative VI | 5 | 2.0 | 4.2 |
| DMSO | 20 gallon | XIV | 42 | Comparative I | 7 | 2.0 | 4.3 |
| NMP | 2 L | IX | 67 | Comparative VII | 7 | 2.6 | 5.9 |
| NMP | 20 gallon | XV | 43 | Comparative II | 8 | 2.6 | 6.1 |

Key:
[4]BET is surface area in m$^2$/g
[5]Dark Decay is Volts dark discharge in 0.5 seconds, to give Vddp.

COMPARATIVE EXAMPLE I

Fabrication of Imaging Member Containing ClGaPc A ClGaPc dispersion was prepared by ball milling 0.2 g of ClGaPc Type-II pigment as prepared in Example XIV, 0.159 g of vinylchloride-vinylacetate-maleic acid terpolymer, 4.72 g of p-xylene and to 2.33 g of n-butyl acetate in a 30 mL bottle containing 70 g of ⅛ inch stainless steel balls. The bottle was put on a roll mill and milled for 1 day. The resulting ClGaPc dispersion was coated onto an aluminized Mylar film, which was previously coated with a 0.1 micron silane layer, using a wire roll. The coated device was dried at 100° C. for 10 minutes. The optical density of the dry ClGaPc charge generator layer was about 1.0 at the wavelength of 780 nanometers. A charge transport solution was prepared by dissolving 2.7 g of N,N'-diphenyl-N,N'-bis(3-methyl phenyl)-1,1'-biphenyl4,4'-diamine, and 4.05 g of polycarbonate in 30.8 g of monochlorobenzene. The solution was coated onto the above ClGaPc generator layer using a 7 mil film applicator. The charge transporting layer thus obtained was dried at 115° C. for 60 minutes to provide a final thickness of about 17 microns. This gave an electrophotographic photoreceptor.

COMPARATIVE EXAMPLE II

An electrophotographic photoreceptor was produced as in Comparative Example I except that the charge generating material used was the chlorogallium phthalocyanine crystal prepared in Example XV instead of that in Example XIV.

COMPARATIVE EXAMPLE III

An electrophotographic photoreceptor was produced as in Comparative Example I except that the charge generating material used was chlorogallium phthalocyanine crystal prepared in Example XVI instead of that in Example XIV.

COMPARATIVE EXAMPLE IV

An electrophotographic photoreceptor was produced as in Comparative Example I except that the charge generating material used was chlorogallium phthalocyanine crystal prepared in Example XVII instead of that in Example XIV.

COMPARATIVE EXAMPLE V

An electrophotographic photoreceptor was produced as in Comparative Example I except that the charge generating material used was chlorogallium phthalocyanine crystal prepared in Example VII instead of that in Example XIV.

COMPARATIVE EXAMPLE VI

An electrophotographic photoreceptor was produced as in Comparative Example I except that the charge generating material used was chlorogallium phthalocyanine crystal prepared in Example VII instead of that in Example XIV.

COMPARATIVE EXAMPLE VII

An electrophotographic photoreceptor was produced as in Comparative Example I except that the charge generating material used was chlorogallium phthalocyanine crystal prepared in Example IX instead of that in Example XIV.

COMPARATIVE EXAMPLE VIII

An electrophotographic photoreceptor was produced as in Comparative Example I except that the charge generating material used was chlorogallium phthalocyanine crystal obtained from production photoreceptor manufacturing designated as Reference 1 instead of that in Example XIV.

COMPARATIVE EXAMPLE IX

An electrophotographic photoreceptor was produced as in Comparative Example I except that the charge generating material used was chlorogallium phthalocyanine crystal obtained from production photoreceptor manufacturing designated as Reference 2 instead of that in Example XIV.

Testing of Imaging Members Containing ClGaPc: The xerographic electrical properties of imaging members prepared as described in Example XVIII above were determined by known means, including as indicated herein electrostatically charging the surfaces thereof with a corona discharge source until the surface potentials, as measured by a capacitively coupled probe attached to an electrometer, attained an initial value $V_0$ of about −500 volts. After resting for 0.5 second in the dark, the charged members attained a surface potential of $V_{ddp}$, dark development potential. Imaging members were then exposed to light from a filtered Xenon lamp with a BO 150 watt bulb, thereby inducing a photodischarge which resulted in a reduction of surface potential to a $V_{bg}$ value, background potential. The wavelength of the incident light was 780 nanometers, and the exposure energy of the incident light varied from 0 to 15 ergs/cm$^2$. The dark decay (D.D.) value was calculated in accordance to the equation, $D.D.=2\times(V_0-V_{ddp})$. By plotting the surface potential against exposure energy, a photodischarge curve was constructed. The photosensitivity of the imaging member can be described in terms of $E_{1/2}$, amount of exposure energy in erg/cm$^2$ required to achieve 50 percent photodischarge from the dark development potential. The photosensitivity of the imaging member can also be described in terms of $E_{7/8}$, that is the amount of exposure energy in erg/cm2 required to achieve 88 percent photodischarge from the dark development potential.

Other modifications of the present invention may occur to one of ordinary skill in the art based upon a review of the present application and these modifications, including equivalents thereof, are intended to be included within the scope of the present invention.

APPENDIX

Sample and Example Correlation Chart

| Process (Synthesis or Treatment) | Example (Type-I) | Dry Mill (Type-IIA) | Type-II | Device ID |
|---|---|---|---|---|
| 2 L Synthesis in DMSO/ DMSO wash | I | IV | VII | Comp. V |
| 2 L Synthesis in DMSO/ DMF wash | II | V | VIII | Comp. VI |
| 2 L Synthesis in NMP/ DMSO wash | III | VI | IX | Comp. VII |
| 20 Gal Synthesis in DMSO/ DMSO wash | X | XII | XIV | Comp. I |
| 20 Gal Synthesis in NMP/ DMF wash | XI | XIII | XV | Comp. II |
| Heat treat Sample XIV at 140° C./72 hrs | — | — | XVI | Comp. III |
| Heat treat Sample XIV at 160° C./15 hrs | — | — | XVII | Comp. IV |
| Mixed Type-IIs for intermediatesensitivities | — | — | 25% NMP(XV) + 75% DMSO(XIV) | XVIII |
| Mixed Type-IIs for intermediatesensitivities | — | — | 50% NMP + 50% DMSO | XIX |
| Mixed Type-IIs for intermediatesensitivities | — | — | 75% NMP + 25% DMSO | XX |
| Production ClGaPc (2.2/5.2) | — | — | Ref. 1 | Comp. VIII |
| Production ClGaPc (2.5/5.8) | — | — | Ref. 2 | Comp. IX |

What is claimed is:

1. A process comprising:

forming a first chlorogallium phthalocyanine (ClGaPc) in N-methyl-2-pyrrolidinone (NMP) to form a ClGaPc (NMP) Type-I product;

forming a second chlorogallium phthalocyanine in dimethyl sulfoxide (DMSO) to form a ClGaPc (DMSO) Type-I product;

separately dry milling and then wet treating the Type-I products to form respective Type-II products;

blending the Type-II products together along with a resin to form a coating mixture; and coating the mixture to form a photoconductive charge generator layer in an electrostatographic imaging article.

2. The process in accordance with claim 1, wherein the coating mixture has from about 10 to about 60 weight percent of ClGaPc (NMP) Type-II product, and from about 60 to about 10 weight percent ClGaPc (DMSO) Type-II product, and from about 30 to about 70 weight percent resin.

3. The process in accordance with claim 1, wherein the coating mixture has from about 20 to about 40 weight percent ClGaPc (NMP) Type-II product, from about 40 to about 20 weight percent of the ClGaPc (DMSO) Type-II product, and from about 40 to about 60 weight percent of a resin.

4. The process in accordance with claim 1, wherein the coating mixture has from about 20 to about 40 weight percent ClGaPc (NMP) Type-II product, from about 40 to about 20 weight percent of the ClGaPc (DMSO) Type-II product, and from about 40 to about 60 weight percent of a resin so that the photoconductive imaging member has an $E_{7/8}$ sensitivity of about 5.5 ergs/cm$^2$.

5. The process in accordance with claim 1, wherein the coating mixture has from about 25 to about 30 weight percent ClGaPc (NMP) Type-II product, from about 25 to about 30 weight per cent of the ClGaPc (DMSO) Type-I, product, and from about 40 to about 50 weight percent of a resin so that the photoconductive imaging member has an $E_{7/8}$ sensitivity of about 5.5 ergs/cm$^2$.

6. The process in accordance with claim 1, wherein the resulting charge generator layer has a $E_{7/8}$ photosensitivity measured as 88% discharge, of from about 4.5 to about 7.0 ergs/cm$^2$.

7. The process in accordance with claim 1, wherein the resin is poly(vinyl butyral), poly(vinyl carbazole), polyesters, polycarbonates, polyacrylates, polyacrylics, polymers or copolymers of vinyl chloride and vinyl acetate, vinylchloride-vinylacetate-malic acid terpolymers, polystyrene, or mixtures thereof.

8. The process in accordance with claim 1, wherein dry milling is accomplished with a vibration-type mill, and wherein wet treating is accomplished with a ball mill in a solvent.

9. An electrostatographic imaging article comprising:

a substrate;

a charge generator layer prepared in accordance with claim 1 overcoated on the substrate; and a charge transport layer overcoated on the charge generator.

10. The article in accordance with claim 9, wherein the article has an $E_{1/2}$ photosensitivity of from about 1.5 to about 3.0 ergs/cm$^2$ and an $E_{7/8}$ photosensitivity of from about 4.5 to about 7.0 ergs/cm$^2$.

11. The article in accordance with claim 9, wherein the article has an $E_{1/2}$ photosensitivity of from about 2.2 to about 2.5 ergs/cm$^2$ and an $E_{7/8}$ photosensitivity of from about 5.0 to about 6.0 ergs/cm$^2$.

12. The article in accordance with claim 9, wherein the charge generator layer contains from about 0 to about 100 parts per million of DMSO and wherein the charge generator layer contains from about 0 to about 100 parts per million of NMP.

13. The article in accordance with claim 9, wherein the charge generator layer contains from about 25 to about 30 weight percent ClGaPc (NMP) Type-II product, from about 25 to about 30 weight percent ClGaPc (DMSO) Type-II product, and from about 40 to about 60 weight percent resin.

14. The article in accordance with claim 9, wherein the ClGaPc (DMSO) Type-II product has an average particle size diameter of from about 50 to about 100 nanometers and the ClGaPc (NMP) Type II product has an average particle size diameter of from about 25 to about 50 nanometers.

15. The article in accordance with claim 9, wherein the ClGaPc (DMSO) Type-II product has a particle surface area of from about 40 to about 70 square meters per gram and wherein the ClGaPc (NMP) Type-II product has a particle surface area of from about 40 to about 70 square meters per gram.

16. The article in accordance with claim 9, wherein the charge generator layer is from about 0.1 to about 0.5 micrometers thick.

17. A process comprising:

forming a chlorogallium phthalocyanine (ClGaPc) in N-methyl-2-pyrrolidinone (NMP) to form chlorogallium phthalocyanine (ClGaPc) (NMP) Type-I product;

dry milling and then wet treating the product to form ClGaPc (NMP) Type-II product;

blending the resulting product with a resin to form a coating mixture; and coating the mixture to form a charge generator layer in a electrostatographic imaging article.

* * * * *